US005191780A

United States Patent [19]

Ohmori et al.

[11] Patent Number: 5,191,780

[45] Date of Patent: Mar. 9, 1993

[54] ROLLER-TYPE STRAIGHTENING APPARATUS FOR H-BEAMS

[75] Inventors: Kazuo Ohmori; Tsuneo Seto; Hitoshi Itakura; Mikio Kohno, all of Okayama; Masaru Nagao, Osaka; Tatsuya Morishita, Osaka; Masayuki Tanigawa, Osaka, all of Japan

[73] Assignee: Kawasaki Steel Corporation, Japan

[21] Appl. No.: 809,926

[22] Filed: Dec. 18, 1991

[30] Foreign Application Priority Data

| | | | |
|---|---|---|---|
| Mar. 19, 1991 | [JP] | Japan | 3-54283 |
| Apr. 22, 1991 | [JP] | Japan | 3-90338 |
| Nov. 1, 1991 | [JP] | Japan | 3-286936 |

[51] Int. Cl.[5] ..... B21D 1/14

[52] U.S. Cl. ..... 72/164; 72/162; 72/224

[58] Field of Search ..... 72/160, 162, 164, 224

[56] References Cited

U.S. PATENT DOCUMENTS

| | | | |
|---|---|---|---|
| 1,071,861 | 9/1913 | Bass | 72/162 |
| 1,255,666 | 2/1918 | Theiss | 72/164 |
| 3,457,754 | 7/1969 | Hagemann | 72/164 |

FOREIGN PATENT DOCUMENTS

| | | | |
|---|---|---|---|
| 84829 | 4/1987 | Japan | 72/160 |
| 260602 | 10/1988 | Japan | 72/224 |
| 317622 | 12/1989 | Japan | 72/164 |
| 127901 | 5/1990 | Japan | 72/224 |
| 1032127 | 6/1966 | United Kingdom | 72/160 |

*Primary Examiner*—Daniel C. Crane
*Attorney, Agent, or Firm*—Austin R. Miller

[57] ABSTRACT

A roller-type straightening apparatus for an H-beam having horizontal rolls for pressing the web of the H-beam are alternately vertically disposed. Pairs of vertical rolls press the outer surfaces of the opposed flanges of the H-beam. The horizontal roll presses the surface of the web of the H-beam. The pairs of vertical rolls are located to correspond in position to each of the horizontal rolls.

7 Claims, 8 Drawing Sheets

ROLLER-TYPE STRAIGHTENING APPARATUS FOR H-BEAMS

BACKGROUND OF THE INVENTION

1. Field of the Invention

The present invention relates to a roller-type straightening apparatus for correcting warping, bending and out-of-squareness of shaped beams, especially H-beams.

2. Description of the Prior Art

In general, rolled H-beams are manufactured by hot rolling by using a universal mill including pairs of web rolls, which are usually generally vertically disposed rolls having their axes in the same generally horizontal plane, sometimes called "horizontal rolls," working in cooperation with right and left flange rolls, generally rotating about vertical axes and sometimes called "vertical rolls."

When an H-beam is cooled after it has been hot rolled, warping, bending and out-of-squareness tend to take place during the cooling process. These defects are usually corrected by using a roller-type straightening apparatus.

The current practice may be understood by referring to FIG. 11 of the drawings, showing a conventional apparatus which performs the correction operation in such a manner that the web 1*a* of an H-beam 1 is pressed by horizontal rolls 2 disposed vertically alternately in the direction in which the H-beam 1 moves. Acting through the web 1*a*, they apply bending deformation to flanges 1*b*. Such bending deformation is repeatedly applied to the flanges 1*b* during movement of the H-beam 1.

The rolls are arranged in such a manner that the horizontal roll 2 presses the juncture between the web 1*a* and the flanges 1*b* to the degree needed to prevent deflection of the web 1*a*. However, if the pressing load generated is too large, the web 1*a* is deflected, causing the flange adjacent to the horizontal roll 2 to be inclined inward and to contact the side surface of the horizontal roll 2, causing plastic deformation of the flange. Therefore the desired squareness cannot be realized, producing the type of structure shown in FIG. 12(*a*) after the attempted correction operation has been completed.

When the pressing load is too large in comparison to the rigidity of the web, deformation takes place in the junction between the web and the flange as shown in FIG. 12(*b*), and the web can be bent. Therefore, satisfactory correction for warping, bending and out-of-squareness cannot be obtained.

In order to overcome the above-described problems, various devices have been proposed, as disclosed in Japanese Patent Laid-Open No. 56-30027, Japanese Patent Laid-Open No. 56-119624, Japanese Patent Laid-Open No. 57-137028 and the like.

The structure disclosed in Japanese Patent Laid-Open No. 56-30027 is arranged in such a manner that a pair of horizontal rolls and another pair of vertical rolls are disposed in front of or in the rear of the roller-type straightening apparatus. The structure disclosed in Japanese Patent Laid-Open No. 56-119624 is arranged in such a manner that right and left forming rolls are disposed at intervals corresponding to at least three horizontal rolls. Furthermore, the structure disclosed in Japanese Patent Laid-Open No. 57-137028 is arranged in such a manner that each correction roll has a tapered portion on the side surface thereof so as to prevent inclination of the flanges.

However, both the above-described structures disclosed in Japanese Patent Laid-Open Nos. 56-30027 and 56-119624 are arranged in such a manner that each flange of the H-beam is without support at the location of the horizontal roll. Therefore, the flange can be inclined by the pressure of the correcting load, causing the shape of the H-beam to become defective in the ways shown in FIGS. 12(*a*) and 12(*b*). Furthermore, the unwanted flange inclination cannot satisfactorily be modified even if the outer surface of the flange is supported by a vertical roll at a position in front of or behind the roller-type straightening apparatus or in a position between the correcting rolls.

Furthermore, the structure disclosed in Japanese Patent Laid-Open No. 57-137028 is arranged in such a manner that the taper given to the side surface of the horizontal roll presses the flange of the H-beam in an inverse direction and causes it to be inclined by the pressing load generated. Therefore, the fear of generation of a defective shape as shown in FIG. 12(*a*) cannot be eliminated. What is even worse, flaws can be generated in the inner surface of the flange.

A so-called thin-wall H-beam may be designed with a ratio of flange thickness to web thickness which is quite considerable. Its purpose is to improve the quality of rolled H-beams as construction materials. In such a case warping cannot be easily corrected due to the problems already described. On the other hand, since out-of-squareness of the flange cannot be corrected on-line, it must be corrected by separate pressing or heating, relying upon the personal perceptions of workers. This causes serious problems in operational conditions, in manufacturing yield and in quality of product.

Furthermore, when using a conventional center type roll shaft, the roll shaft has to be removed from the roll chock bearing to exchange the horizontal rolls which are fastened via sleeves and the like. Therefore, excessive labor and time are required, increasing manufacturing cost.

SUMMARY OF THE INVENTION

It is accordingly an object of the present invention to provide an apparatus for correcting warping of a rolled H-beam, capable of preventing deformation of the junction between the web and the flange, preventing inclination and warping of the flange, correcting out-of-squareness of an H-beam flange, and having the further advantage that the correction rolls can quickly be exchanged.

In order to achieve the above-described object, according to one aspect of the present invention, there is provided a roller-type straightening apparatus for an H-beam arranged in such a manner that several sets of horizontal rolls are spaced-apart from each other along the longitudinal axis of the H-beam for pressing the web of the H-beam, and are alternately disposed above and below the web, and the roller-type straightening apparatus comprises pairs of vertical rolls arranged for pressing the outer surfaces of the flanges of the H-beam with such a spacing that the outer surface of the horizontal roll presses the surface of the web of the H-beam, the pairs of vertical rolls being disposed in longitudinal positions located to correspond to each of the horizontal rolls.

Furthermore, the structure is preferably arranged with a pair of flange screw-down rolls for pressing the end portions of the flanges with a predetermined load corresponding to changes of width of the flange of the H-beam, and are disposed coaxially with the horizontal rolls in a manner to correspond in position to the horizontal rolls.

Other and further objects, features and advantages of the invention will be appear more fully from the following description, which is intended to illustrate selected specific examples of ways to practice the invention but not to limit the scope of the invention which is defined in the appended claims.

DESCRIPTION OF THE PREFERRED EMBODIMENTS

Figure 1:
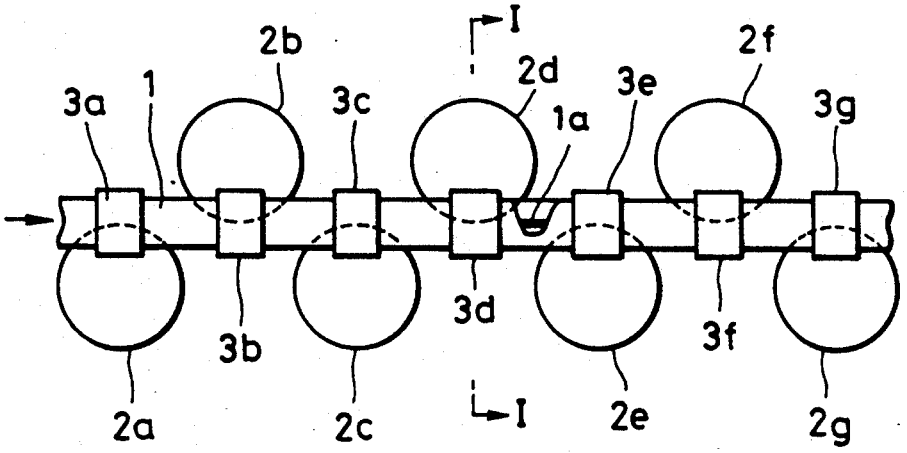
FIG. 1 schematically illustrates the configuration of H-beam correcting elements according to one embodiment of the present invention.
Figure 2:
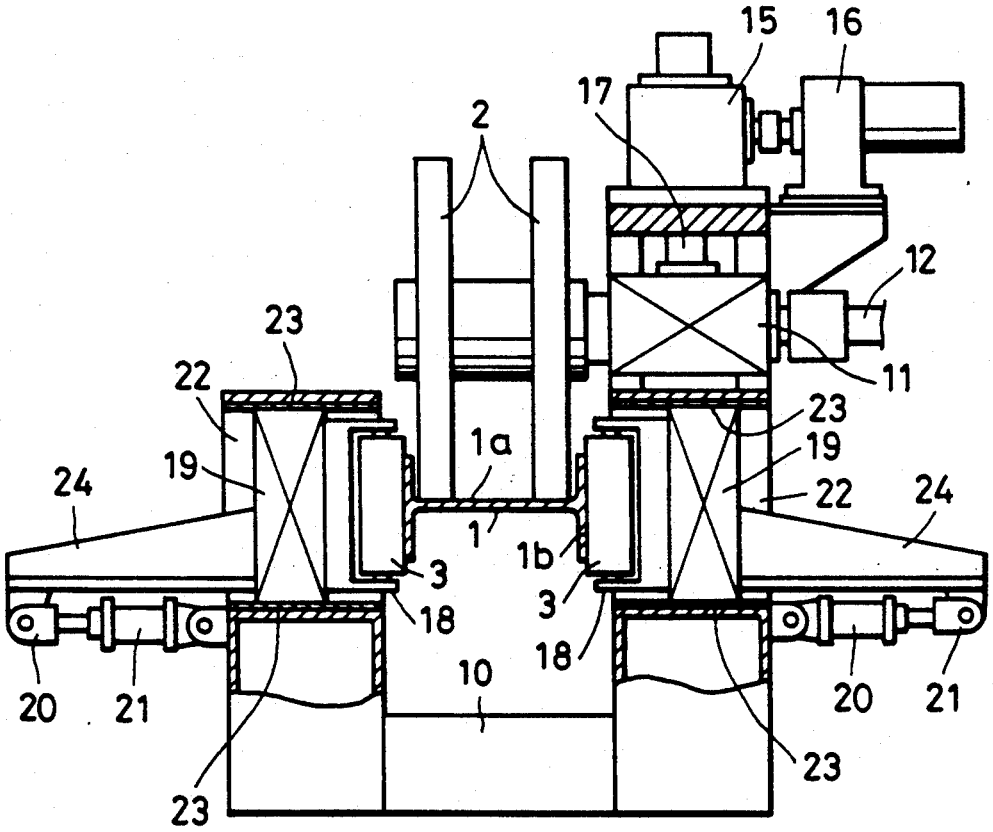
FIG. 2 is a front elevational partial cross sectional view, as indicated by the lines and arrows I—I which appear in FIG. 1.

The operation according to the present invention as distinguished from the prior art will now be described. As shown in FIGS. 1 and 2, which illustrate this invention, horizontal rolls 2 (2*a*, 2*b* . . . 2*g*) for pressing the web of an H-beam 1 are spaced apart along the direction in which the H-beam moves, as indicated by the arrow at the left of FIG. 1. Furthermore, pairs of vertical rolls 3 (3*a*, 3*b* . . . 3*g*) for pressing the outer surfaces of the two side flanges are disposed to correspond to the horizontal rolls 2*a* to 2*g*, the vertical rolls 3*a* to 3*g* pressing inwardly upon the outer surfaces of the two H-beam side flanges 1*b*. Further, the surface of each horizontal roll 2*a* to 2*g* presses upon the surface 1*a* of the web of the H-beam. In this manner each horizontal roll 2*a* to 2*g* presses alternatively upwardly and downwardly on the web 1*a* and simultaneously each correspondingly positioned vertical roll 3*a* to 3*g* is brought into pressure contact with both of the outer surfaces of the two side flanges 1*b* of the H-beam to press them toward each other. Therefore, inclination of the flange 1*b*, due to pressure applied to the web 1*a* by the horizontal rolls 2*a* to 2*g*, is prevented.

It has been found that when each position at which each vertical roll 3*a* to 3*g* presses the flange 1*b* is substantially deviated from each position at which each corresponding horizontal roll 2*a* to 2*g* presses the web 1*a*, the restrictive effect upon the flange is reduced or seriously dissipated depending upon the rigidity or lack of rigidity of the flange 1*b*. Therefore, in order to obtain a superior restrictive effect the axis of each vertical roll 3*a* to 3*g* must be located substantially where the outer surface of each horizontal roll 2*a* to 2*g* presses upon the surface of the web 1*a*.

The location at which the outer surface of the horizontal roll 2*a* to 2*g* presses the surface of the web 1*a* can be geometrically defined as being within about 50% of the length of the portion of the H-beam in which the corresponding vertical and horizontal rolls are positioned in opposition to each other. However, it is most effective to arrange the rolls in such a manner that the axis of each vertical roll 3 is positioned in substantially the same perpendicular plane as the axis of the corresponding horizontal roll 2.

The outer surfaces of the two flanges 1*b*, 1*b* of the H-beam 1 are pressed by the corresponding vertical rolls 3, 3 at substantially the location where the outer surface of the corresponding horizontal rolls 2 press the corresponding portion of the web 1*a* of the H-beam. Furthermore, the apparatus is preferably arranged in such a manner that the axis of a vertical roll 3 can be inclined in the direction in which the H-beam moves, within a generally vertical plane which is generally perpendicular to the axis of the horizontal roll, as will be further described.

If the axis of any vertical roll 3 is inclined by $\theta°$ from the vertical plane, a force FW acts on the outer surface of the flange 1*b* in a direction in which the web 1*a* is pressed by the horizontal roll 2. This is due to the flange-pressing force FH applied by the vertical roll 3. The above-described force FW is determined by the friction factor $\mu$ between the outer surface of the flange 1*b* and the surface of the vertical roll in accordance with the following equation:

$$FW = \mu x\ FH$$

where friction factor $\mu$ has a value which depends upon the slip factor $\epsilon$ (=tan $\theta$) between the outer surface of the flange 1*b* and the surface of the vertical roll 3.

Therefore, the force acting on the web can be reduced by FW when the forces pressing the web are caused to be the same. In this way, the deformation of the web 1*a* can be prevented.

Furthermore, the axis of the vertical roll 3 is preferably inclined as described above, and further described hereafter, so that the flange restricting force is increased.

In addition, when either flange has defective squareness this can be corrected by inclining the associated vertical roll 3 in the direction of the width of the flange. The direction of such inclination is toward the upper or lower portion which is not pressed or not backed up by a horizontal roll 2. On the contrary, if the flange 1*b* is pressed in an attempt to incline it toward the (upper or lower) flange portion on which the horizontal roll 2 is present, the deformation of the web 1*a* is enhanced and thereby the squareness of the flange becomes defective. What is even worse, the beneficial effect of this invention will be lost and warping cannot satisfactorily corrected.

The angle of inclination of the vertical roll 3 is adjustable to a value previously determined, as will be further described, depending upon the size of the H-beam to be corrected.

At least one pair of the vertical rolls of all of the vertical roll groups 3*a* to 3*g* is inclined in such a manner that the right and the left rolls may be simultaneously inclined or that, in the alternative, any of them may be independently inclined.

Figure 8:
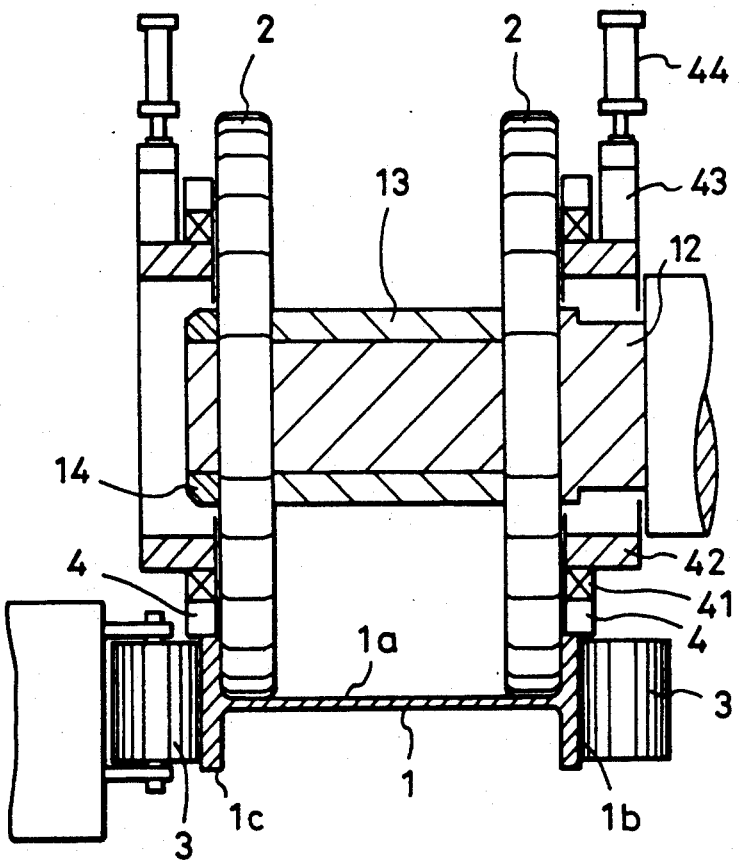
FIG. 8 is a front elevational partial cross sectional view illustrating still another embodiment of the invention.

In order to prevent deformation of the metal in the area of the junction between the web 1*a* and the flanges 1*b*, 1*b* of the H-beam, and undesirable inclination of either flange, a structure arranged as shown in FIG. 8 is preferably employed in which the web 1*a* is pressed by the horizontal roll 2 and simultaneously the end portion 1*c* of the flange is pressed by a flange screw-down roll 4. As a result, the load acting on the horizontal roll 2 can be reduced. By reducing the load acting on the web 1*a*, unwanted deformation of the junction between the web 1*a* and the flange 1*b* and undesirable inclination of the flange 1*b* can be prevented.

Preferred embodiments of the present invention will now be described with reference to FIGS. 1 to 10 of the drawings.

Referring to FIG. 1, the web 1*a* of the H-beam is shown as horizontal and the flanges 1*b* vertical; reference numerals 2*a* to 2*g* represent horizontal web-engaging rolls arranged for pressing the web 1*a* of an H-beam 1, the horizontal rolls 2*a* to 2*g* being sequentially disposed in the direction in which the H-beam moves in such a manner that the horizontal rolls 2*a* to 2*g* are positioned alternately above and below the web 1*a*.

Reference numerals 3*a* to 3*g* represent vertical flange-engaging rolls for pressing the outer surfaces of the two side flanges 1*b* of the H-beam 1. According to the embodiment of FIG. 1, the axis of each of the vertical rolls 3*a* to 3*g* is positioned in the same vertical plane as the axis for each of the horizontal rolls 2*a* to 2*g*, forming a plurality of equally-spaced sets of opposed vertical and horizontal rolls. Furthermore, the vertical rolls 3*a* to 3*g* are disposed with vertical axes positioned to correspond to the axes of the spaced-apart horizontal rolls 2*a* to 2*g*.

FIG. 2 is a front elevational partial cross sectional view taken along line I—I of FIG. 1 and illustrating a configuration in which the horizontal rolls 2 are positioned above the web 1*a*. An alternative configuration in which the horizontal rolls 2 are disposed below the web can readily be understood by inverting FIG. 2.

Referring to FIG. 2, 10 represents a frame; the spaced-apart horizontal rolls 2, 2 are supported by a chock 11 in a cantilever manner so that the horizontal rolls 2, 2 can be rotated by a drive shaft 12.

Reference numeral 15 represents a screw-down device for the horizontal rolls 2. It is driven by a gear motor 16 and its screw 17 is connected to the chock 11 so that the pressure applied to the web 1*a* by the horizontal rolls 2, 2 can be adjusted.

Reference numeral 3 represents opposed vertical rolls which are respectively rotatably held by holding members 18. Reference numeral 19 represents movable blocks for respectively securing the holding members 18 and as well as being arranged in such a manner that the movable blocks 19 can respectively be horizontally moved in openings 22 horizontally formed in the frame 10 by hydraulic cylinders 20. When the hydraulic cylinders 20 are operated, the vertical rolls 3 are caused to move toward and away from the surfaces of the two side flanges of the H-beam 1 via the movable blocks 19 and the holding members 18. As a result, the outer surfaces of the flanges can be pressed with essentially any desired or required force.

Reference numeral 23 represents liners for guiding the four corners of each of the movable blocks 19. Reference numeral 24 represents brackets for connecting the movable blocks 19 to rod heads 21 of the hydraulic cylinders 20.

The roller-type straightening apparatus thus-constituted is disposed as shown in FIG. 1 before the positions of the horizontal rolls 2*a* to 2*g* and the vertical rolls 3*a* to 3*g* are respectively positioned as designed. Then, the H-beam 1 is caused to move longitudinally in the direction designated by the arrow to correct warping.

Figure 3:
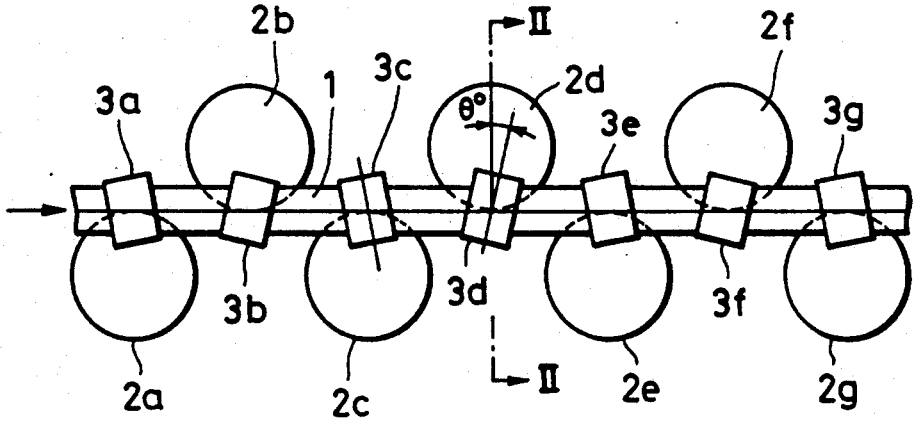
FIG. 3 schematically illustrates the configuration of elements according to another embodiment of the present invention.
Figure 4:
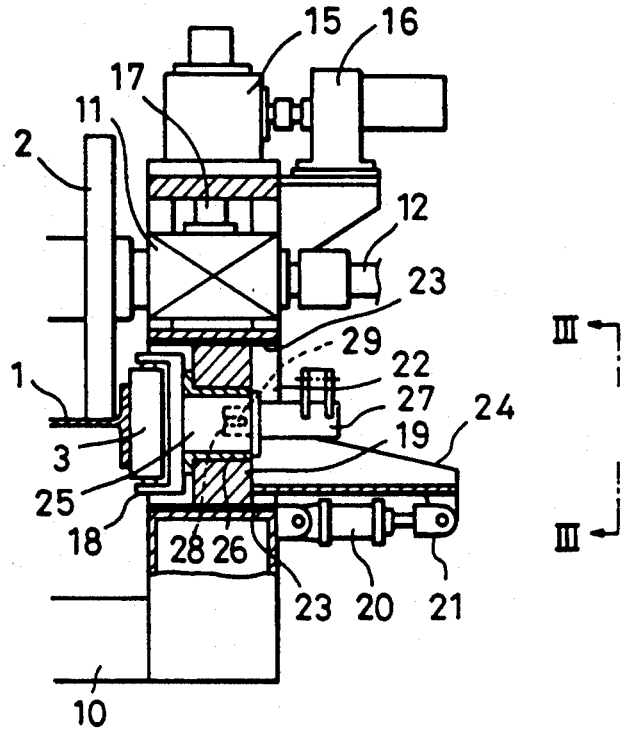
FIG. 4 is a front elevational partial cross sectional view, as indicated by the lines and arrows II—II which appear in FIG. 3 and illustrating a one-half portion of the apparatus.
Figure 5:
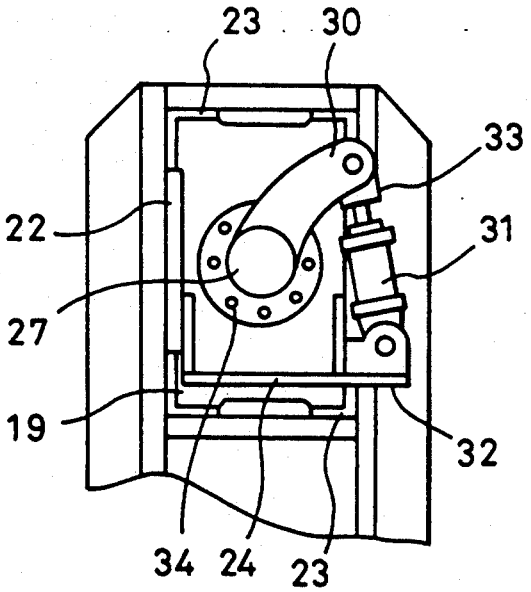
FIG. 5 is a side elevational cross sectional view as indicated by the lines and arrows III—III which appear in FIG. 4.

FIGS. 3 to 5 illustrate embodiments designed in such a manner that the vertical rolls 3 may be inclined forwardly or rearwardly in a plane generally parallel to the plane of the adjacent beam flange in such a manner that the vertical rolls 3*a* to 3*g* can, as shown in FIG. 3, be inclined to any desired degree as indicated by the angle $\theta$.

Turning now to FIGS. 4 and 5 of the drawings, FIG. 4 is a front elevational partial cross sectional view taken along line II—II of FIG. 3 and illustrating a portion of the apparatus as applied to one flange of an H-beam. A shaft portion 25 extends from the holding member 18 which holds the vertical roll 3, the shaft portion 25 being inserted into a bush 26 fitted to a shaft hole formed in the movable block 19. Furthermore, a shaft 27 is fastened to the outer surface of the shaft portion 25 by bolts 34 (see FIG. 5). In addition, the shaft 27 has an engagement portion 28 which is inserted into the above-described shaft portion 25 and as well as the shaft 27 is held against rotation with respect to the shaft portion 25 by a key 29.

Reference numeral 30 (FIG. 5) represents an inclined arm secured to the shaft 27 at a position remote from the movable block 19 so that an inclining cylinder 31 or the like (to be described in further detail later) does not interfere with the frame 10 even if the vertical roll 3 is moved all the way to the flange of the H-beam 1.

FIG. 5 is viewed as indicated by the lines and arrows III—III of FIG. 4, wherein the inclining arm 30 is drivingly connected to a rod head 33 of an inclining cylinder 31. Reference numeral 32 represents a fastening portion which is formed by extending one side of the bracket 24 to which the inclining cylinder 31 is fastened.

According to this embodiment, when the inclining cylinder 31 is operated and thereby the shaft 27 and the holding member 18 are inclined via the inclining arm 30, the vertical roll 3 can be variably and selectively inclined through the angle ($\theta°$), which can previously be manually set.

Although the embodiment of FIGS. 4 and 5 is arranged in such a manner that a gear motor is used as the drive for the screw-down device and a hydraulic cylinder is used to tilt the vertical roll, other drive means may, of course, be employed. Furthermore, although the pressure of the horizontal roll may be adjusted with respect to the frame, the frame itself, together with the vertical roll, may be moved upward or downward.

Figure 6:
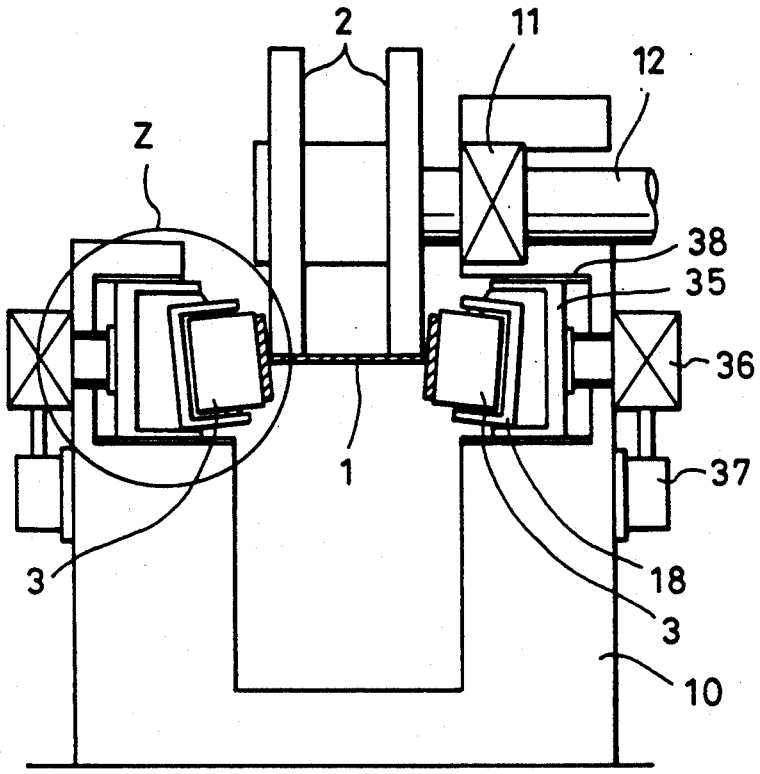
FIG. 6 is a front elevational partial cross sectional view illustrating another embodiment of the invention.

FIG. 6 shows how the vertical roll 3 can be adjusted and inclined along the widthwise direction of the H-beam web. The vertical roll 3 is supported by the holding member 18 fastened to a block 35.

The screw-down device 36 for the vertical roll 3 is driven by a motor 37. The screw-down device 36 for the vertical roll 3 and the motor 37 are secured to the frame 10. The block 35 is able to move in the widthwise direction of the web on a guide 38 fastened to the frame 10.

Figure 7:
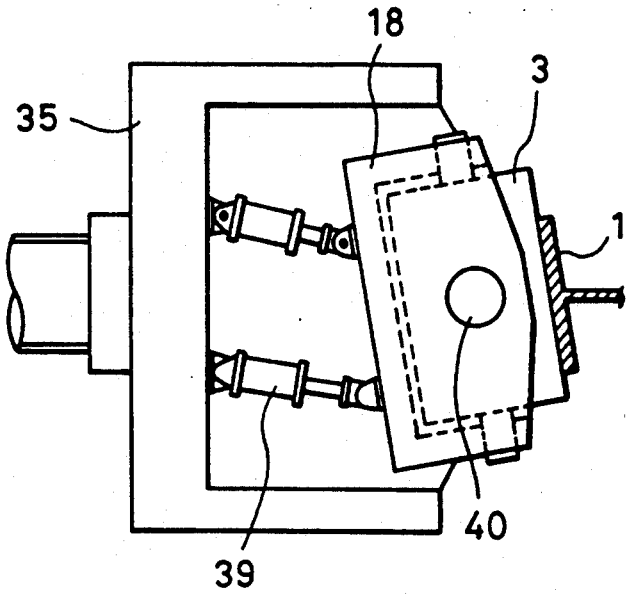
FIG. 7 is a front elevational view which illustrates the portion Z of FIG. 6 in detail.

FIG. 7 illustrates the portion Z of FIG. 6 in more detail. Reference numeral 39 represents a cylinder for inclining the holding member 18 fastened to the block 35 in a direction generally crosswise of the H-beam. The holding member 18 is fastened to the block 35 by means of a pin 40. The angle of the vertical roll 3 can be changed as desired in the widthwise direction of the web.

FIG. 8 illustrates an embodiment of the invention arranged in such a manner that a pair of flange screw-down rolls 4 are provided adjacent the vertical rolls 3. They are coaxially disposed to the horizontal rolls 2 and arranged to press the end portions of the flanges of the H-beam 1 with a predetermined load to correspond to changes of the flange width of the H-beam. The horizontal rolls 2 are fastened to the drive shaft 12 in such a manner that its position in the direction of the width of the web is fixed by a spacer 13 and nuts 14. The flange screw-down rolls 4 are fastened to hollow shafts 42 via bearings 41 so that the flange screw-down rolls 4 are able to rotate around the hollow shafts 42. The hollow shafts 42 are held by roll chock 43, the roll chock 43 being pressed at a predetermined load by cylinders 44. The vertical rolls 3 are positioned in contact with the outer surfaces of the flanges 1*b* in such a manner that the central shaft of each of the vertical rolls 3 is positioned in the same plane as that of the horizontal rolls 2 to make a right angle with the web of the H-beam.

According to the present invention, the amount of the screw-down load to be applied to the flange is determined depending upon the size of the material and the type of the steel. For example, in a case of an H-beam having a flange width of about 200 mm, the relationship between the screw-down load and the flange thickness can be calculated, so that the load acting on the web can be reduced to about two-thirds by applying the pressure to the end portion of the web.

Figure 9:
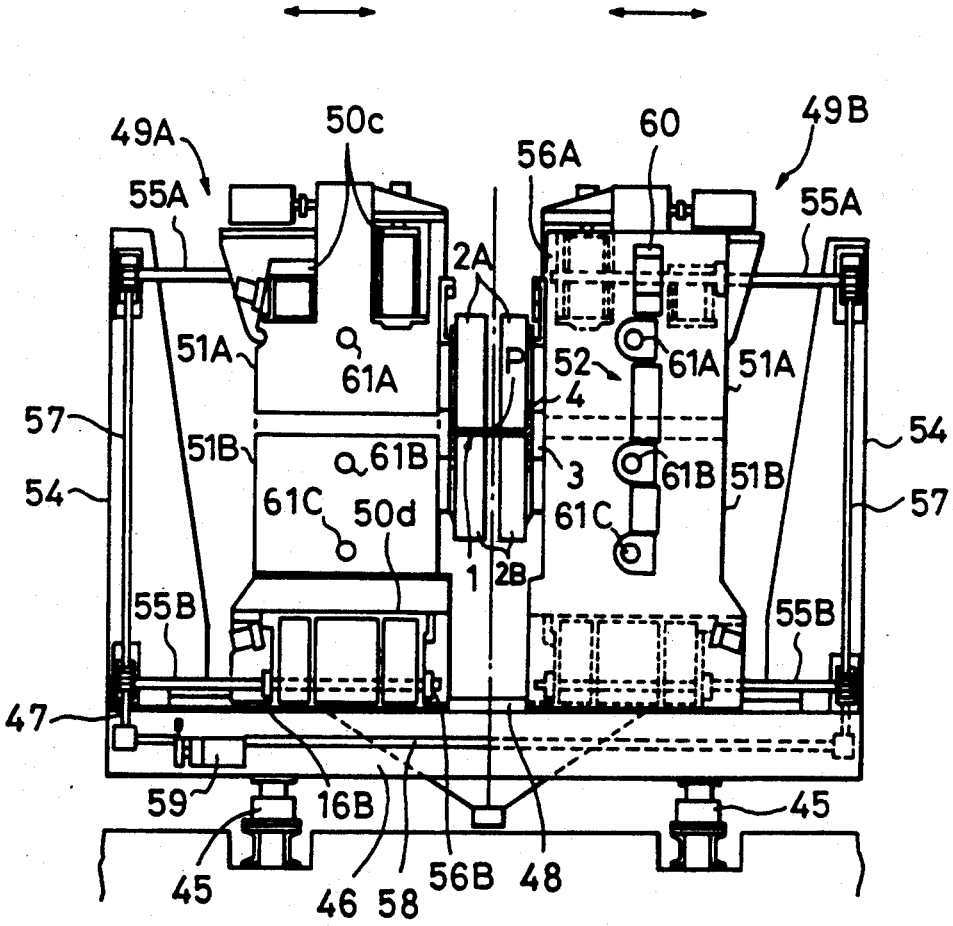
FIG. 9 is a front elevational vertical cross sectional view which illustrates yet another embodiment of the present invention.
Figure 10:
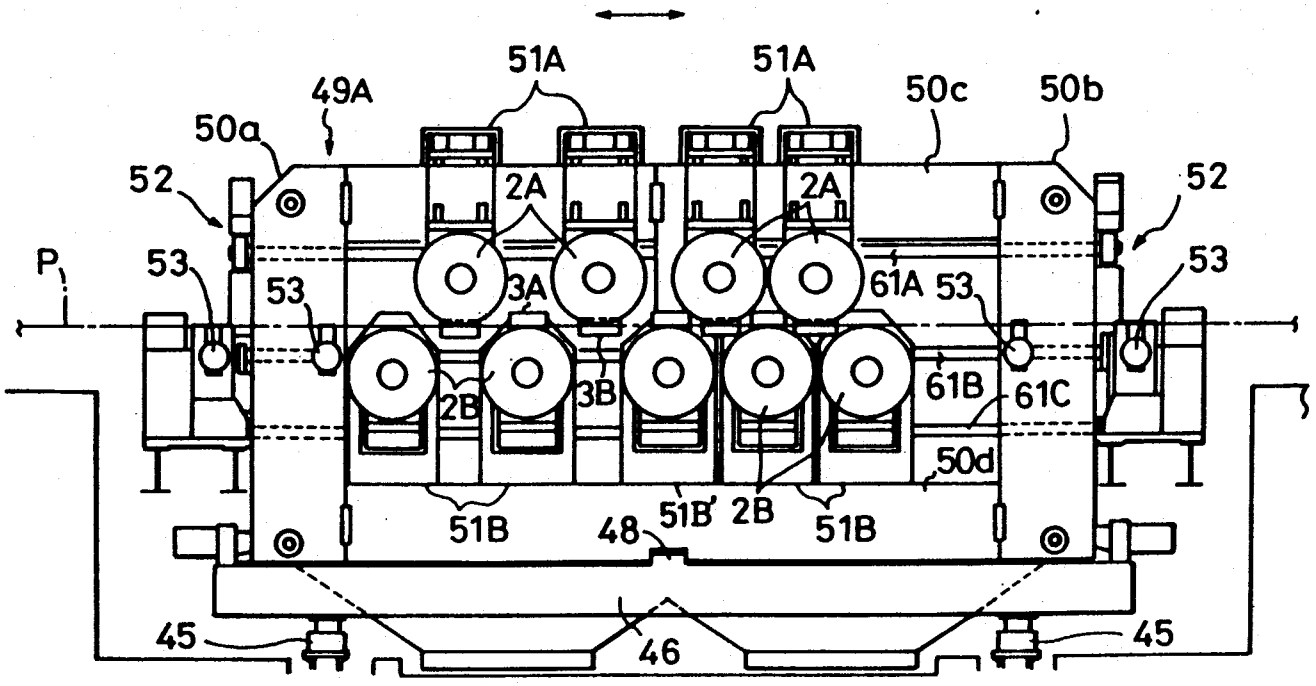
FIG. 10 is a side elevational view of the embodiment of FIG. 9.
Figure 11:
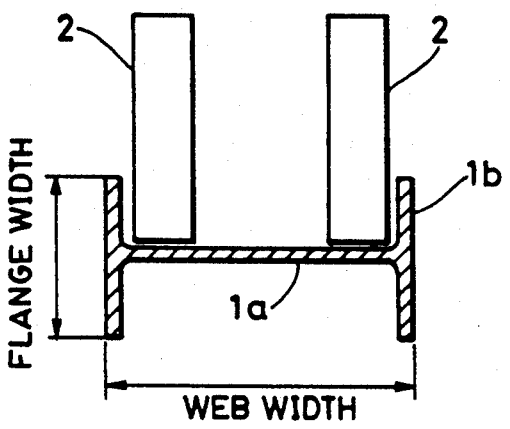
FIG. 11 PRIOR ART
FIG. 11 is a cross sectional view which illustrates a conventional roller-type straightening machine.
Figure 12A:
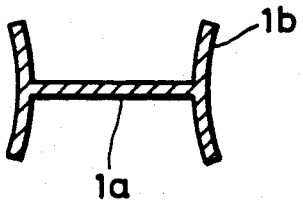
FIG. 12(a) PRIOR ART
FIGS. 12(*a*) and 12(*b*) are also conventional and illustrate defective shapes of H-beams after prior art correction.
Figure 12B:
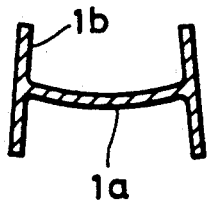
FIG. 12(b) PRIOR ART

Referring to FIGS. 9 and 10, a support base 46 is disposed along the pass line P of the H-beam. At its four corners it is supported by an adjustment jack 45 for movement up and down. Furthermore, horizontal frames 49A and 49B are disposed on the support base 46. The right and the left frames 49A and 49B are movable toward and away from each other by an approach movement device 47 via a widthwise guide rail 48. As shown in FIG. 10, the above-described horizontally disposed frames 49A and 49B are provided with an upper roll support frame 51A having an upper horizontal roll 2A which is brought from above into contact with the web 1*a* and the inner surface of the flange 1*b* of the H-beam 1. An upper flange screw-down roll 4A is brought into contact with the leading portion of the flange 1*b* from above and an upper vertical roll 3A is brought into contact with the outer surface of the flange 1*b* from aside.

Furthermore, a lower roll support frame 51B is provided for lower horizontal rolls 2B which are brought into contact with the web 1*a* and the inner surface of the flange 1*b* of the H-beam 1 from below. A lower flange screw-down roll 4B which is brought into contact with the leading portion of the flange 1*b* from a side portion and a lower vertical roll 3B which is brought into contact with the outer surface of the flange 1*b* from a side portion.

The above-described horizontally disposed frames 49A and 49B have longitudinal frame members 50*a* and 50*b* arranged longitudinally of the pass line P. An upper frame 50*c* is arranged between the top portions of the longitudinal frame members 50*a* and 50*b* along the pass line P and a lower frame 50*d* is connected between the lower end portions of the longitudinal frame members 50*a* and 50*b* along the pass line P. Four upper roll support frames 51A are movably disposed on the upper frame members 50*c* in the direction of the pass line P. Furthermore, five lower roll support frames 51B are movably disposed in the lower frame member 50*d* in the direction of the pass line P except for the central lower roll support frame 51B'. A pitch adjustment device 52 is connected to move the upper roll support frame 51A and the lower roll support frame 51B in the direction of the pass line P so as to adjust the correcting position. Furthermore, guide rolls 53 for guiding the H-beam 1 are respectively disposed in front of the longitudinal frame members 50*a*, 50*b* and the front frame member 50*a* and in the rear of the longitudinal frame members 50*a* and 50*b*.

The above-described approach movement device 47 is arranged in such a manner that approaching and withdrawing upper and lower screw shafts 55A and 55B laterally extending in the direction of the pass line P are respectively rotatably disposed in the upper portion and the lower portion of stationary columns 54 respectively erected outside the longitudinal frames 50*a* and 50*b*. The above-described approaching/withdrawing upper and lower screw shafts 55A and 55B are screwed into approaching/withdrawing female screw members 56A and 56B respective disposed in the longitudinal frame members 50*a* and 50*b*. In the portion of the stationary columns 54, worm drive shafts 57 for rotating the approaching/withdrawing upper and lower screw shafts 55A and 55B via worm gear mechanism are vertically disposed at the base portions of the approaching/withdrawing upper and lower screw shafts 55A and 55B. The lower end portions of the laterally disposed worm drive shafts 57 are connected to each other by horizontal linkage shafts 58 via gear boxes. The longitudinal horizontal linkage shafts 58 are respectively connected to the output shaft of approaching/withdrawing motors 59. As a result, when the above-described approaching/withdrawing motors 59 are rotated in synchronization with each other, the approaching/withdrawing upper and the lower screw shafts 55A and 55B are rotated via the horizontal linkage shafts 58 and the worm drive shafts 57. Therefore, the lateral frames 49A and 49B can be caused to approach/withdraw from each other by the actions of the approaching/withdrawing female screw members 56A and 56B.

The above-described pitch adjustment device 52 has pitch adjustment motors 60 respectively disposed on the front surface of the front frame member 50*a* and on the rear surface of the rear frame member 50*b* and arranged to rotate an upper roll pitch adjustment shaft 61A and lower roll pitch adjustment shafts 61B and 61C via vertical shafts and gear boxes. The upper roll-pitch adjustment shaft 61A, the lower roll pitch adjustment shafts 61B and 61C are disposed in parallel to the pass line P between the front and the rear frame members 50*a* and 50*b*. Furthermore, pitch adjustment female screw members (omitted from illustration) to be screw-fastened to the roll pitch adjustment shafts 61A to 61C are provided for the upper and the lower roll support frames 51A and 51B except for the central lower roll support frame 51B'. Therefore, when upper and the lower roll pitch adjustment shafts 61A to 61C are rotated by the pitch adjustment motor 60, the upper and the lower roll support frames 51A and 51B except for the central lower roll support frame 51B' can be moved in the direction of the pass line P along the upper and the lower frame members 50*c* and 50*d*.

According to the embodiment of FIGS. 9 and 10, the lateral frames 49A and 49B which can approach and withdraw from each other by the approach movement device 47 are disposed on the support base 46. Furthermore, the horizontal rolls 2, the vertical rolls 3 and the flange screw-down rolls 4 are fastened to the roll support frames 51A and 51B disposed in the lateral frames 49A and 49B. This enables roll exchanging work to be easily performed. Furthermore, the apparatus according to the present invention can easily be adapted to an H-beam having a constant outer dimension by simply adjusting the interval between the lateral frames 49A and 49B with the use of the approach movement device 47.

According to the present invention, larger pressure can be applied in comparison to pressures achievable in conventional methods of correcting warping in which the web is pressed to give the flange deformation by bending. The vertical rolls for restricting the outer surfaces of the flanges are disposed in such a manner that their central axes are disposed in the same plane on which the central axes of the horizontal rolls are disposed, so that the squareness of the flange is simultaneously corrected with the warping correction operation. Therefore, the rigidity of the H-beam web against the pressure applied by the horizontal rolls can be increased, allowing a large force to be applied to the web and an improved correction effect to be obtained.

Furthermore, flange screw-down rolls for pressing the end portions of the flanges are disposed on substantially the same axis as the horizontal web-engaging rolls so as to cause the end portions of the flange to receive a portion of the load generated at the time of flange bending correction. As a result, the load acting on the web can be reduced and therefore a very large pressure can be applied while protecting the web from deformation.

Furthermore, lateral frames which are able to approach and withdraw from each other are formed on the support base on the two sides of the pass line of the H-beam. Furthermore, the horizontal rolls, the vertical rolls and the flange screw-down rolls are detachably disposed in the roll support frames provided for the lateral frames. Therefore, the roll exchanging work can be completed in a very short time. Furthermore, by approaching/withdrawing the lateral roll support frames, the interval between the screw-down rolls can arbitrarily be set. Therefore an H-beam having a constant outer size, which has been widely used in recent years, can be easily corrected.

Although the invention has been described with reference to certain preferred forms, it is understood that the present disclosure of the preferred form may be changed in a variety of details of construction. Various combinations and arrangements of parts may resorted to without departing from the spirit and the scope of the invention as hereinafter claimed.

What is claimed is:

1. A straightening apparatus for an elongated H-beam movable along a longitudinally extending pass line, said H-beam having a horizontally arranged web and a pair of opposed vertically arranged flanges extending along a longitudinal axis of said H-beam comprising:

a plurality of spaced-apart horizontal web-engaging rolls arranged in a substantially straight line for pressing the web of the H-beam and alternately vertically disposed against opposite faces of said web above and below the web, said web-engaging rolls being arranged so that said web is unsupported on a face directly opposite from each web engaging roll, said horizontal web engaging rolls having axes extending substantially horizontally, a plurality of pairs of spaced-apart flange-engaging vertical rolls arranged in a substantially straight line in position for pressing the surfaces of said flanges, said vertical rolls having axes extending substantially vertically, said pairs of vertical flange-engaging rolls being disposed to correspond substantially in position along the length of said H-beam to the positions of each of said horizontal web-engaging rolls along the H-beam so that the axes of each pair of vertical rolls substantially cross the axis of the corresponding horizontal roll.

2. A roller-type straightening apparatus according to claim 1, wherein means are provided for inclining at least one of said vertical flange-engaging rolls in a direction extending substantially along the longitudinal axis of said H-beam.

3. The apparatus defined in claim 2 wherein said inclination occurs in a plane which is substantially perpendicular to the axial direction of said horizontal web-engaging roll.

4. A roller-type straightening apparatus for an H-beam according to any one of claims 1, 2 and 3, wherein means are provided for adjusting the distance between pairs of flange-engaging rolls by adjustment along the web direction of said H-beam.

5. A roller-type straightening apparatus for an H-beam according claim 1 wherein means are provided for inclining at least one of said flange-engaging rolls in the web direction of said H-beam.

6. A roller-type straightening apparatus for an H-beam according to claim 1 wherein flange screw-down rolls are provided for pressing the end portion of an H-beam flange with a predetermined load corresponding to change in the width of said flange of said flange of said H-beam, and are disposed coaxially with said horizontal web-engaging rolls in positions to correspond to said horizontal web-engaging rolls.

7. A roller-type straightening apparatus for an H-beam according to claim 1 wherein right and left frames are provided at opposed sides of said H-beam and are movable toward and away from each other, said frames being disposed on both sides of the longitudinal axis of said H-beam on a support base, and wherein a pair of drive shafts are disposed in the same axis and said horizontal web-engaging rolls and said flange screw-down roll, said frames being detachably provided for said adjacent two drive shafts, and wherein said vertical flange-engaging roll is also detachably provided adjacent to said two rolls in a roll support frame provided for said right and left frames.

* * * * *

UNITED STATES PATENT AND TRADEMARK OFFICE

CERTIFICATE OF CORRECTION

PATENT NO. : 5,191,780

DATED : March 9, 1993

INVENTOR(S) : Kazuo Ohmori et al

It is certified that error appears in the above-identified patent and that said Letters Patent is hereby corrected as shown below:

Column 10, line 51, please delete "of said flange " second occurrence.

Signed and Sealed this

Thirtieth Day of November, 1993

Bruce Lehman

*Attest:*

BRUCE LEHMAN

*Attesting Officer*

*Commissioner of Patents and Trademarks*